US008857167B2

(12) United States Patent
Johnson et al.

(10) Patent No.: US 8,857,167 B2
(45) Date of Patent: Oct. 14, 2014

(54) INTEGRAL ACCUMULATOR/RESERVOIR SYSTEM

(75) Inventors: Daniel S. Johnson, Loveland, CO (US); Kenneth E. Netzel, Loveland, CO (US); Daniel Jude Hueber, Fort Collins, CO (US); Christopher A. Pennekamp, Fort Collins, CO (US); Jonathan L. Reynolds, Fort Collins, CO (US)

(73) Assignee: Steelhead Composites, Golden, CO (US)

( * ) Notice: Subject to any disclaimer, the term of this patent is extended or adjusted under 35 U.S.C. 154(b) by 891 days.

(21) Appl. No.: 12/932,808

(22) Filed: Mar. 7, 2011

(65) Prior Publication Data

US 2011/0219761 A1 Sep. 15, 2011

Related U.S. Application Data

(60) Provisional application No. 61/311,188, filed on Mar. 5, 2010.

(51) Int. Cl.
*F15B 1/26* (2006.01)
*F15B 1/16* (2006.01)

(52) U.S. Cl.
CPC ..... *F15B 1/26* (2013.01); *F15B 2201/4053* (2013.01); *F15B 2201/3152* (2013.01); *F15B 1/165* (2013.01); *F15B 2201/4155* (2013.01); *F15B 2201/205* (2013.01)
USPC ..... 60/414; 138/30

(58) Field of Classification Search
USPC ..... 60/414, 418; 138/26, 30
See application file for complete search history.

(56) References Cited

U.S. PATENT DOCUMENTS

| | | | | |
|---|---|---|---|---|
| 339,885 | A | 4/1886 | Hill | |
| 3,963,053 | A * | 6/1976 | Mercier | 138/30 |
| 3,999,387 | A | 12/1976 | Knopf | |
| 4,134,621 | A | 1/1979 | Smedley et al. | |
| 4,351,409 | A * | 9/1982 | Malik | 60/414 |
| 4,785,956 | A * | 11/1988 | Kepler et al. | 138/30 |
| 4,986,383 | A | 1/1991 | Evans | |
| 5,004,874 | A | 4/1991 | Theisen et al. | |
| 6,076,349 | A | 6/2000 | Stepheson et al. | |
| 6,712,166 | B2 | 3/2004 | Rush et al. | |
| 6,945,893 | B2 | 9/2005 | Grillo et al. | |
| 7,021,410 | B2 | 4/2006 | Hughes | |
| 7,082,850 | B2 | 8/2006 | Hughes | |
| 7,104,920 | B2 | 9/2006 | Beaty et al. | |
| 7,125,362 | B2 | 10/2006 | Beaty et al. | |
| 7,214,156 | B2 | 5/2007 | Oliver | |
| 7,272,987 | B2 | 9/2007 | Hughes | |
| 7,296,407 | B2 * | 11/2007 | Rose | 60/414 |
| 7,311,163 | B2 | 12/2007 | Oliver | |
| 7,335,123 | B2 | 2/2008 | Morscheck et al. | |
| 7,367,415 | B2 | 5/2008 | Oliver | |
| 7,434,640 | B2 | 10/2008 | Hughes | |
| 7,463,962 | B2 | 12/2008 | Bruneman et al. | |

(Continued)

*Primary Examiner* — Thomas E Lazo
(74) *Attorney, Agent, or Firm* — Samuel M. Freund; Cochran Freund & Young LLC

(57) ABSTRACT

An integral accumulator/reservoir system including a low pressure vessel having a low-pressure vessel wall defining a low-pressure vessel cavity; a high-pressure accumulator having a high-pressure accumulator wall defining a high-pressure accumulator cavity, the high-pressure accumulator being disposed in the low-pressure vessel cavity, the high-pressure accumulator wall including an aluminum layer; a flexible bladder, the flexible bladder being disposed in the high-pressure accumulator cavity; and a sensor module operably connected to the aluminum layer.

20 Claims, 9 Drawing Sheets

(56) References Cited

U.S. PATENT DOCUMENTS

| | | | |
|---|---|---|---|
| 7,562,522 | B2 | 7/2009 | Yan |
| 7,564,213 | B2 | 7/2009 | Bockelmann et al. |
| 7,624,570 | B2 | 12/2009 | Reuter et al. |
| 7,637,285 | B2 | 12/2009 | Weber |
| 7,647,997 | B2 | 1/2010 | Oliver |
| 2006/0102394 | A1 | 5/2006 | Oliver |
| 2006/0169503 | A1 | 8/2006 | Oliver et al. |
| 2006/0169504 | A1 | 8/2006 | Oliver et al. |
| 2007/0012032 | A1 | 1/2007 | Hu |
| 2007/0023213 | A1 | 2/2007 | Hughes |
| 2007/0084653 | A1 | 4/2007 | Hughes et al. |
| 2007/0277507 | A1 | 12/2007 | Yan |
| 2008/0022664 | A1 | 1/2008 | Reuter et al. |
| 2009/0005214 | A1 | 1/2009 | Hughes |

* cited by examiner

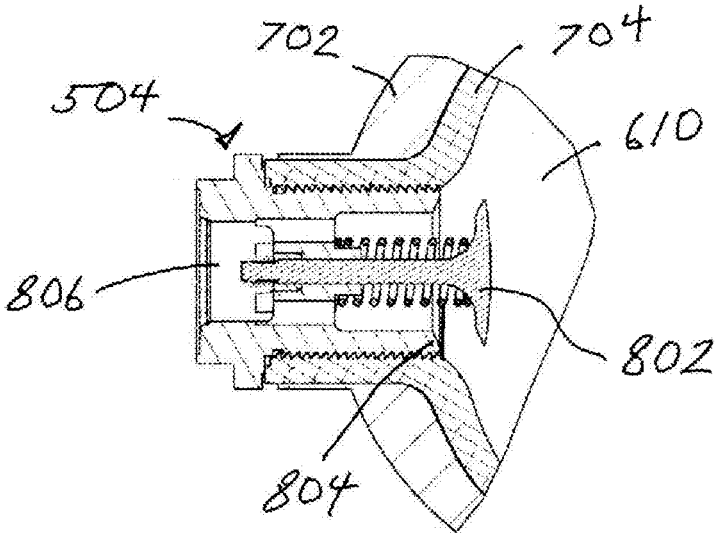
Fig, 8
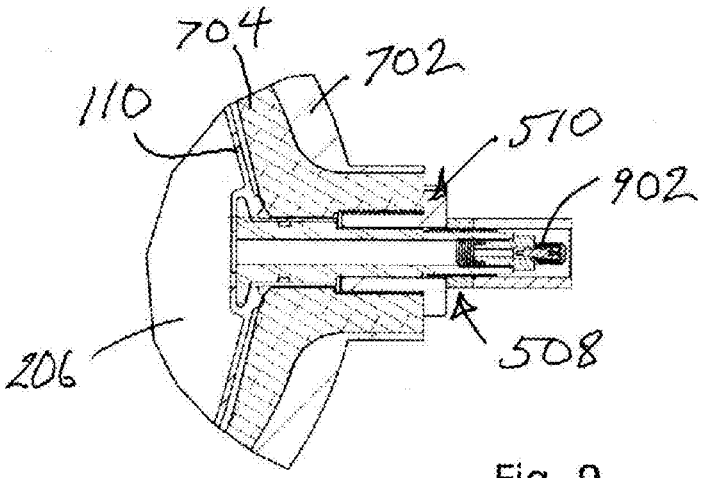
Fig, 9

INTEGRAL ACCUMULATOR/RESERVOIR SYSTEM

CROSS-REFERENCE TO RELATED APPLICATIONS

This application claims priority from U.S. Provisional Application Ser. No. 61/311,188 filed Mar. 5, 2010, the complete subject matter of which is incorporated herein by reference in its entirety.

TECHNICAL FIELD

The technical field of this disclosure is braking energy regeneration systems for hybrid hydraulic vehicles, particularly, integral accumulator/reservoir system for hybrid hydraulic vehicles.

BACKGROUND

Hybrid hydraulic systems for vehicles harness the lost kinetic energy that occurs during braking of a vehicle. Kinetic energy is captured by a power transfer system, and subsequently stored as potential energy in an accumulator. This potential energy is later transferred very quickly to kinetic energy which used to accelerate the vehicle, thereby improving fuel efficiency. The accumulator systems store a large amount of energy. Typical accumulator systems include a separate accumulator tank and a separate reservoir tank. Unfortunately, this configuration of accumulator and reservoir tanks presents problems.

Because of the large amount of potential energy stored in the accumulator systems, such systems must be designed to avoid uncontrolled release of the potential energy. One approach has been to make the walls of the accumulators thick enough that catastrophic failure becomes virtually impossible. Unfortunately, this increases the mass of the accumulator system and can negate any energy savings from the energy recovery since the acceleration of the vehicle must also accelerate the massive accumulator. The separate accumulator and reservoir tank configuration also presents a problem, because the separate tanks require more space on the chassis of the vehicle, thus decreasing available room for passengers, cargo, or other components.

It would be desirable to have an integral accumulator/reservoir system that would overcome the above disadvantages.

SUMMARY OF THE INVENTION

One aspect of the invention provides an integral accumulator/reservoir system, the system including a low pressure vessel having a low-pressure vessel wall defining a low-pressure vessel cavity; a high-pressure accumulator having a high-pressure accumulator wall defining a high-pressure accumulator cavity, the high-pressure accumulator being disposed in the low-pressure vessel cavity, the high-pressure accumulator wall including an aluminum layer; a flexible bladder, the flexible bladder being disposed in the high-pressure accumulator cavity; and a sensor module operably connected to the aluminum layer.

Another aspect of the invention provides a braking energy regeneration system for use with a vehicle prime mover, the system including a power transfer module operably connected to the vehicle prime mover; a hydraulic pump system operably connected to the power transfer module, the hydraulic pump system having an axial piston pump in fluid communication with a fixed displacement pump; an integral accumulator/reservoir system operably connected to the hydraulic pump system, the integral accumulator/reservoir system having a high-pressure accumulator, a low-pressure vessel, and a flexible bladder; and a control system operably connected to the vehicle prime mover, the power transfer module, the hydraulic pump system, and the integral accumulator/reservoir system. The fixed displacement pump is in fluid communication with the low-pressure vessel, the fixed displacement pump is in fluid communication with the axial piston pump, and the axial piston pump is in fluid communication with the high-pressure accumulator. The integral accumulator/reservoir system includes the low pressure vessel having a low-pressure vessel wall defining a low-pressure vessel cavity; the high-pressure accumulator having a high-pressure accumulator wall defining a high-pressure accumulator cavity, the high-pressure accumulator being disposed in the low-pressure vessel cavity, the high-pressure accumulator wall including an aluminum layer; the flexible bladder being disposed in the high-pressure accumulator cavity; and a sensor module operably connected to the aluminum layer.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

BRIEF DESCRIPTION OF THE DRAWINGS

FIG. 8 is a detailed cross-section view of a poppet valve for a high-pressure accumulator for an integral accumulator/reservoir system made in accordance with the present invention.

FIG. 9 is a detailed cross-section view of a fill valve for a high-pressure accumulator for an integral accumulator/reservoir system made in accordance with the present invention.

DETAILED DESCRIPTION

Figure 1:
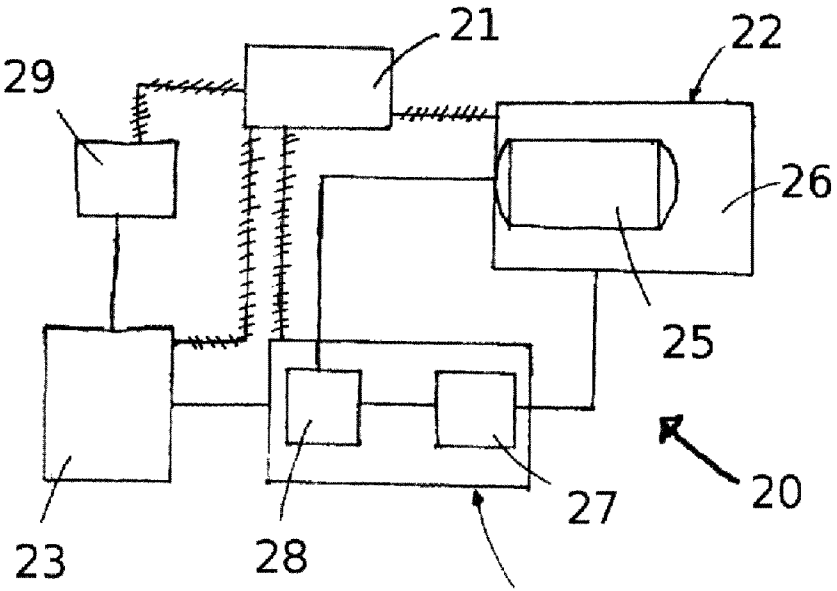
FIG. 1 is a block diagram of a braking energy regeneration system with an integral accumulator/reservoir system made in accordance with the present invention.

FIG. 1 is a block diagram of a braking energy regeneration system with an integral accumulator/reservoir system made in accordance with the present invention. The braking energy regeneration system 20 is a closed-loop system including an automatic control system 21, an integral accumulator/reservoir system 22, a power transfer module 23, and a hydraulic pump system 24. The hydraulic pump system 24 includes a fixed displacement pump 27 in fluid communication with an axial piston pump 28. The power transfer module 23 performs the function of a torque converter in a vehicle, exchanging power with the vehicle prime mover 29. As indicated by the hatched lines, the control system 21 is operably connected to each of the integral accumulator/reservoir system 22, the power transfer module 23, hydraulic pump system 24, and the vehicle prime mover 29. The control system 21 can be a microcontroller operably connected to a variety of vehicle systems that allows the microcontroller to collect data inputs and provide the appropriate signals to each system. The braking energy regeneration system 20 can also include other control valves (not shown) operably connected to the control system 21 to manage hydraulic flow as desired for a particular application.

The integral accumulator/reservoir system 22 is a tank-in-tank system with a high-pressure accumulator 25 enclosed within a low pressure vessel 26. The low pressure vessel 26 is in fluid communication with a small fixed displacement pump 27 within the hydraulic pump system 24; the fixed displacement pump 27 is in fluid communication with the axial piston pump 28; and the high-pressure accumulator 25 is in fluid communication with an axial piston pump 28 within the hydraulic pump system 24. Thus, there is a hydraulic flow path between the low-pressure vessel 26 and the high-pressure accumulator 25. The incorporation of the high-pressure accumulator 25 within the low pressure vessel 26 conserves space on the vehicle chassis and provides a barrier around the high-pressure accumulator 25. In one embodiment, the high-pressure accumulator 25 is also in fluid communication with the low pressure vessel 26 through an emergency relief valve. In case of an emergency, such as a vehicle crash or a potential tank failure, the pressure in the high-pressure accumulator 25 can be relieved to the low pressure vessel 26 through the emergency relief valve by the emergency relief valve in response to an emergency signal.

The high-pressure accumulator 25 exchanges energy with the vehicle through the axial piston pump 28 and the power transfer module 23. When the vehicle brakes, the power transfer module 23 drives the axial piston pump 28, increasing the pressure in the high-pressure accumulator 25 by pumping hydraulic fluid into the high-pressure accumulator 25 and compressing the gas in the flexible bladder. When the vehicle accelerates, the pressure from the high-pressure accumulator 25 drives the axial piston pump 28, releasing the energy to the vehicle through the power transfer module 23. The fixed displacement pump 27 is operably connected to the low-pressure vessel 26 to provide hydraulic fluid to the axial piston pump 28 during braking to compress the gas in the flexible bladder and two receive hydraulic fluid from the axial piston pump 28 during acceleration as the pressure on the gas in the flexible bladder is released. Those skilled in the art will appreciate that the braking energy regeneration system 20 can be controlled by the control system 21 to operate in different modes as desired for a particular application.

In one embodiment, the braking energy regeneration system 20 is for use with a vehicle prime mover 29 and includes a power transfer module 23 operably connected to the vehicle prime mover 29; a hydraulic pump system 24 operably connected to the power transfer module 23, the hydraulic pump system 24 having an axial piston pump 28 in fluid communication with a fixed displacement pump 27; an integral accumulator/reservoir system 22 operably connected to the hydraulic pump system 24, the integral accumulator/reservoir system 22 having a high-pressure accumulator 25, a low-pressure vessel 26, and a flexible bladder (not shown); and a control system 21 operably connected to the vehicle prime mover 29, the power transfer module 23, the hydraulic pump system 24, and the integral accumulator/reservoir system 22. The fixed displacement pump 27 is in fluid communication with the low-pressure vessel 26, the fixed displacement pump 27 is in fluid communication with the axial piston pump 28, and the axial piston pump 28 is in fluid communication with the high-pressure accumulator 25. The integral accumulator/reservoir system 22 includes the low pressure vessel 26 having a low-pressure vessel wall defining a low-pressure vessel cavity; the high-pressure accumulator 25 having a high-pressure accumulator wall defining a high-pressure accumulator cavity, the high-pressure accumulator being disposed in the low-pressure vessel cavity; and the flexible bladder, the flexible bladder being disposed in the high-pressure accumulator cavity. The high-pressure accumulator wall includes an aluminum layer, a carbon/epoxy layer exterior to the aluminum layer, and a plastic layer interior to the aluminum layer and adjacent to the flexible bladder.

Figure 2:
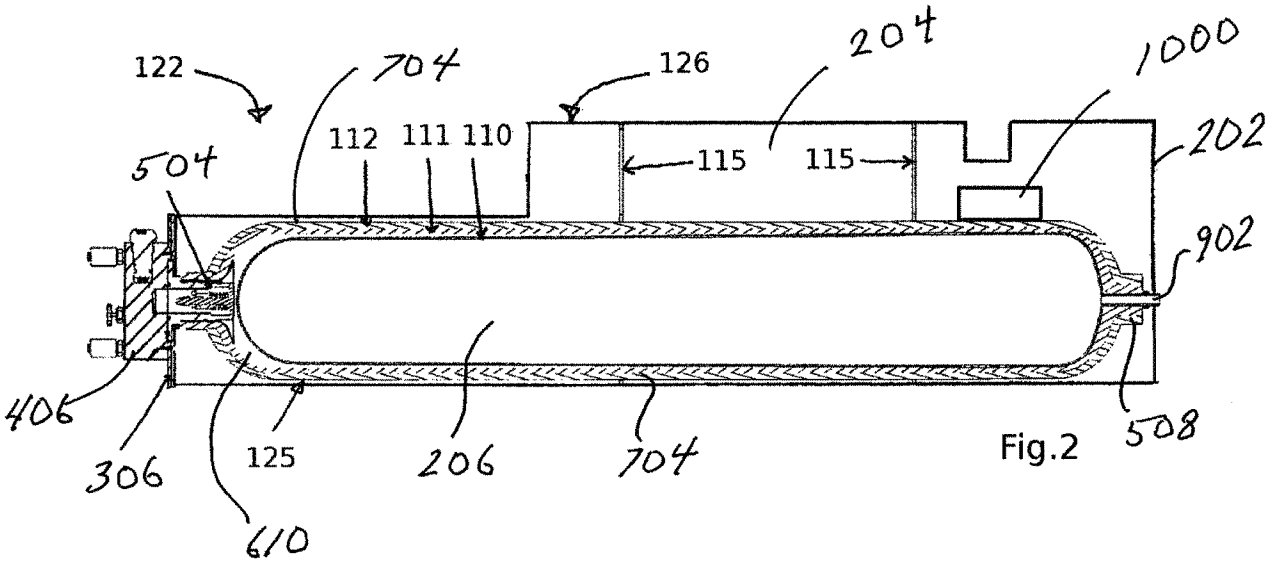
FIG. 2 is a cross section side view of an integral accumulator/reservoir system made in accordance with the present invention.

FIG. 2 is a cross section side view of an integral accumulator/reservoir system made in accordance with the present invention. The integral accumulator/reservoir system 122 includes a low pressure vessel 126 completely enclosing a high-pressure accumulator 125, which encloses a flexible bladder 110. The low pressure vessel 126 has a low-pressure vessel wall 202 defining a low-pressure vessel cavity 204, and the high-pressure accumulator 125 has a high-pressure accumulator wall defining a high-pressure accumulator cavity 610. The high-pressure accumulator 125 is disposed in the low-pressure vessel cavity 204, and the flexible bladder 110 is disposed in the high-pressure accumulator cavity 610. The high-pressure accumulator wall 704 includes an aluminum layer 111, a carbon/epoxy layer 112 exterior to the aluminum layer 111, and a plastic layer (not shown) interior to the aluminum layer 111 and adjacent to the flexible bladder 110. Supports 115 can be used to maintain placement of the high-pressure accumulator 125 within the low-pressure vessel 126. A sensor module 1000 can be used to monitor the high-pressure accumulator 125 with a strain gauge, temperature sensor, or the like. In one embodiment, the sensor module 1000 is bonded to the aluminum layer 111. The sensor module 1000 can include multiple arrays of sensors attached to various points on the high-pressure accumulator 125. The sensor module 1000 can be in communication with the control system of the braking energy regeneration system.

Fill valve 902 of the fill valve assembly 508 passes through the low-pressure vessel wall 202, connecting the flexible bladder cavity 206 with the exterior of the integral accumulator/reservoir system 122. The fill valve 902 can be used to precharge the flexible bladder 110 with a gas such as nitrogen. Poppet valve assembly 504 connects the high-pressure accumulator cavity 610 to the manifold assembly 406 through the low-pressure vessel wall 202. The manifold assembly 406 provides flow paths for hydraulic fluid to the low-pressure vessel 126 and high-pressure accumulator 125.

Figure 3:
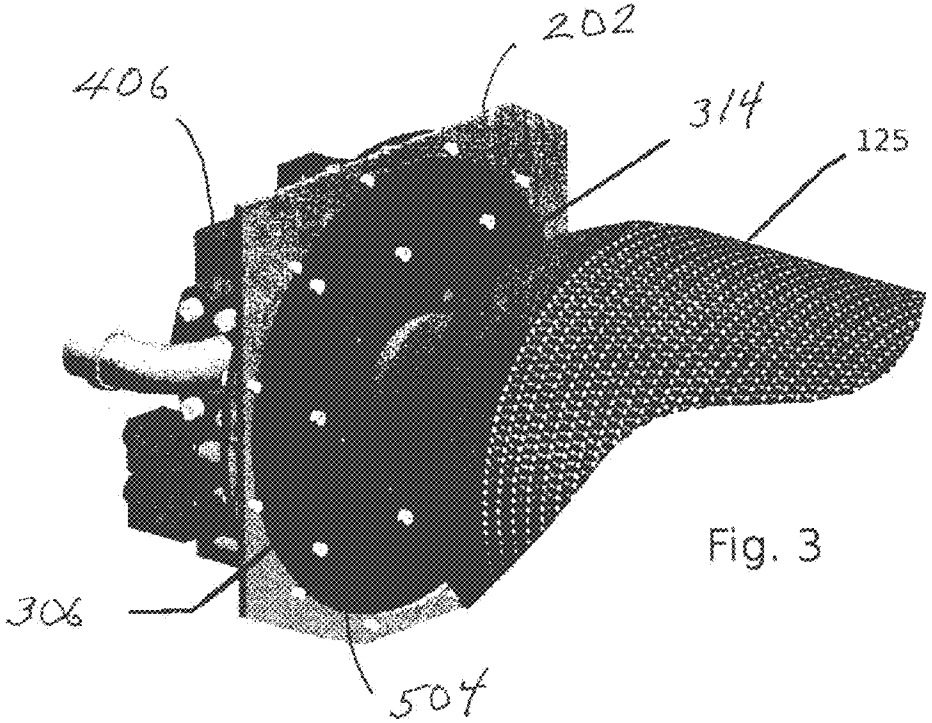
FIG. 3 is an isometric view of a mounting plate and bleed back port for an integral accumulator/reservoir showing made in accordance with the present invention.

FIG. 3 is an isometric view of a mounting plate and bleed back port for an integral accumulator/reservoir showing made in accordance with the present invention.

The mounting plate 306 connects the poppet valve assembly 504 to the low-pressure vessel walls 202. The poppet valve assembly 504 is in fluid communication with the manifold assembly 406 and the high-pressure accumulator 125. A bleed back port 314 is in fluid communication with the manifold assembly 406 to allow high-pressure leakage of hydraulic fluid to drain into the low-pressure vessel. The bleed back port 314 can also be used in connection with an emergency relief valve release pressure from the high-pressure accumulator 125 to the low-pressure vessel 126. In case of an emergency, such as a vehicle crash or potential tank failure, the emergency relief valve can be opened. In one embodiment, the emergency relief valve is the poppet valve itself.

Figure 4:
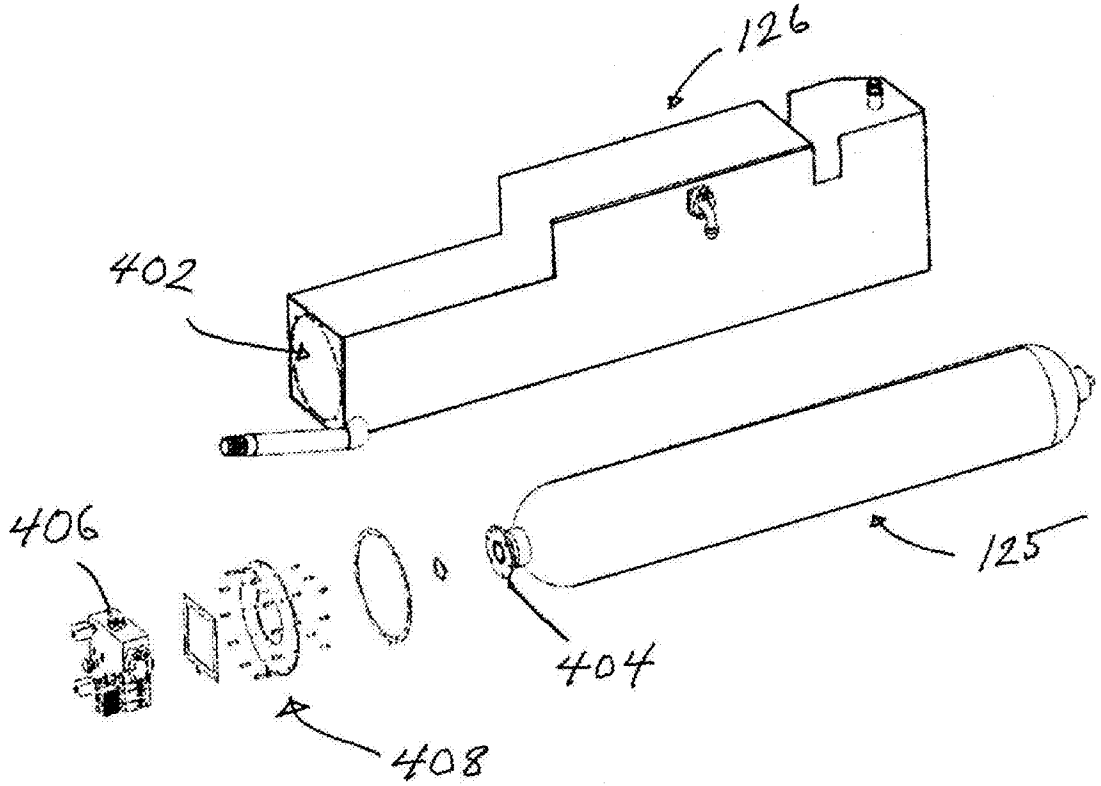
FIG. 4 is an exploded view of a low pressure vessel and high-pressure accumulator for an integral accumulator/reservoir system made in accordance with the present invention.

FIG. 4 is an exploded view of a low pressure vessel and high-pressure accumulator for an integral accumulator/reservoir system made in accordance with the present invention. The low-pressure vessel 126 receives the high-pressure accumulator 125 through the low-pressure vessel opening 402. A manifold assembly 406 provides flow paths to the low-pressure vessel 126 and high-pressure accumulator 125. Gasket/flange assembly 408 provides an interface and seal between the low-pressure vessel opening 402, the poppet valve assembly flange 404, and the manifold assembly 406.

The low-pressure vessel 126 can be any lightweight vessel operable to receive low-pressure hydraulic fluid, such as hydraulic fluid up to 100 psi, for example. In one embodiment the low-pressure vessel 126 can be made of welded aluminum. In another embodiment, the low-pressure vessel 126 can be formed of a single piece of blow molded high-density polyethylene (HDPE). Those skilled in the art will appreciate that the low-pressure vessel 126 can be made of any lightweight material to maintain a low mass for the integral accumulator/reservoir system.

The high-pressure accumulator 125 can be any accumulator operable to receive high-pressure hydraulic fluid, such as hydraulic fluid up to 6000 psi, for example. The high-pressure accumulator 125 can be sized to provide the desired energy storage and pressure. In one embodiment the high-pressure accumulator 125 has an interior volume in the high-pressure accumulator cavity of about 6000 cubic inches and a length of about 73 inches.

The wall of the high-pressure accumulator 125 can include an aluminum layer, a carbon/epoxy layer exterior to the aluminum layer, and a plastic layer interior to the aluminum layer and adjacent to the flexible bladder. The aluminum layer can be part of an aluminum vessel, such as a cylindrical tank. In one embodiment, the aluminum is heat treated to permit microcracks to form under fatigue, rather than permitting catastrophic failure. The microcracks allow detectable leakage of hydraulic fluid from the high-pressure accumulator 125. The carbon epoxy layer is also porous, so the hydraulic fluid leaks from the high-pressure accumulator 125 into the low-pressure vessel 126.

The carbon/epoxy layer can include carbon fiber windings set in an epoxy bed. In one embodiment, the quantity and orientation of the carbon fiber windings in the carbon/epoxy layer are selected so that the carbon/epoxy layer can carry about 60% of the pressure load of the high-pressure accumulator 125. For example, long fibers of the epoxy winding can be wound radially about the aluminum vessel.

The plastic layer can act as a liner inside of the aluminum shell. In one embodiment, the plastic layer is a rotomolded plastic liner formed of high-density polyethylene (HDPE). In one embodiment, the plastic layer is rotomolded in place inside the aluminum shell. Because of its elasticity, the plastic layer increases the number of pressure cycles the high-pressure accumulator 125 can withstand. The plastic layer also increases the lifetime of the flexible bladder by providing a very smooth surface that the flexible bladder can slide against.

In one embodiment, the wall of the high-pressure accumulator 125 can also include a nonstructural fiberglass layer exterior to the carbon/epoxy layer. The nonstructural fiberglass layer allows users to detect if the high-pressure accumulator has suffered any impact or has been excessively abraded.

Figure 5:
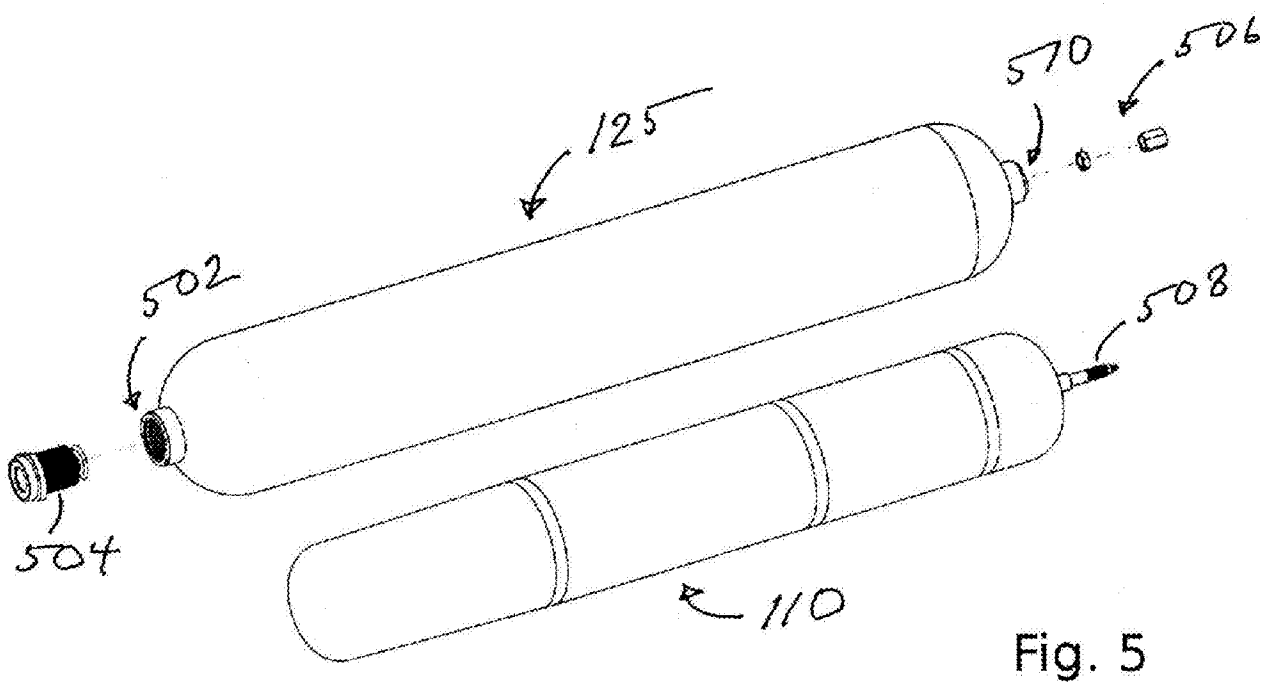
FIG. 5 is an exploded view of a high-pressure accumulator and flexible bladder for an integral accumulator/reservoir system made in accordance with the present invention.

FIG. 5 is an exploded view of a high-pressure accumulator and flexible bladder for an integral accumulator/reservoir system made in accordance with the present invention. The high-pressure accumulator 125 receives the flexible bladder 110 through the poppet valve accumulator opening 502. The flexible bladder 110 is secured in the high-pressure accumulator 125 at fill valve accumulator opening 510 with threaded assembly 506 secured to fill valve assembly 508. The fill valve of the fill valve assembly 508 is used to precharge the flexible bladder 110 with a gas such as nitrogen, which stores the energy when the high-pressure accumulator cavity is charged with hydraulic fluid.

The poppet valve in the poppet valve assembly 504 prevents the flexible bladder 110 from pushing out of the high-pressure accumulator cavity when the flexible bladder 110 is precharged with gas. The poppet valve assembly 504 is threaded complementary to the poppet valve accumulator opening 502 for ease of installation of the flexible bladder 110. The threading allows use of a larger diameter poppet valve accumulator opening, compared to an anti-extrusion style valve. In one embodiment, the diameter of the poppet valve accumulator opening 502 is 3 inches, which allows a full thickness bladder to be inserted into the high-pressure accumulator. The larger opening permits use of a full thickness flexible bladder, avoiding problems with gas permeation through the bladder and extending the life of the bladder.

The flexible bladder 110 can be made of any flexible material compatible with the hydraulic fluid. In one embodiment, the flexible bladder 110 has a thickness of 0.125 inches to provide reasonable resistance to gas permeation. A thick flexible bladder 110 is desirable to prevent the gas from diffusing through the wall of the flexible bladder 110. Gas diffusion reduces the precharge of gas in the flexible bladder 110 and also requires the flexible bladder 110 to be filled more often.

Figure 6:
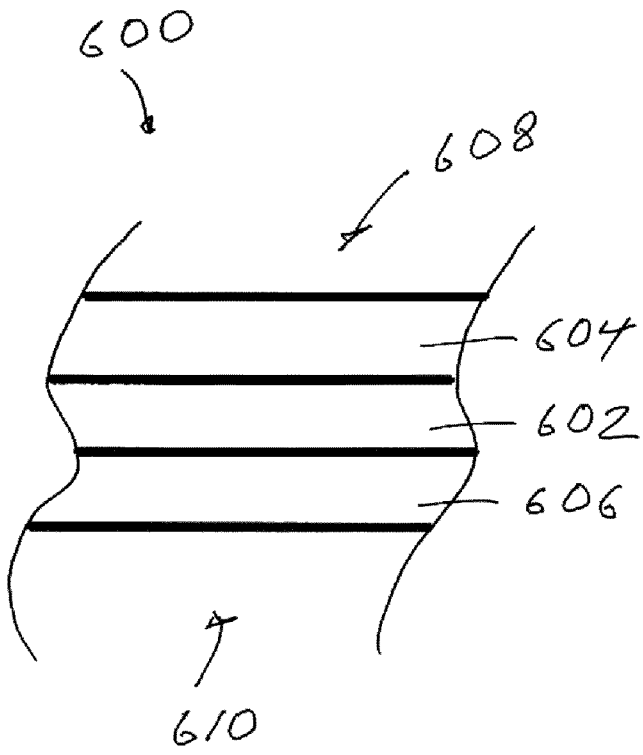
FIG. 6 is a detailed cross-section view of a wall for a high-pressure accumulator for an integral accumulator/reservoir system made in accordance with the present invention.

FIG. 6 is a detailed cross-section view of a wall for a high-pressure accumulator for an integral accumulator/reservoir system made in accordance with the present invention. The high-pressure accumulator wall of the high-pressure accumulator includes an aluminum layer 602, a carbon/epoxy layer 604 exterior to the aluminum layer 602, and a plastic layer 606 interior to the aluminum layer 602 and adjacent to the flexible bladder. Both of the carbon epoxy layer 604 and the plastic layer 606 are exposed to hydraulic fluid. The carbon epoxy layer 604 is exposed to the low-pressure vessel cavity 608, and the plastic layer 606 is exposed to the high-pressure accumulator cavity 610 and the flexible bladder.

The aluminum layer 602 can be part of an aluminum vessel, such as a cylindrical tank. In one embodiment, the aluminum is heat treated to permit microcracks to form under fatigue, rather than permitting catastrophic failure. The microcracks allow detectable leakage of hydraulic fluid from the high-pressure accumulator 125. The carbon epoxy layer is also porous, so the hydraulic fluid leaks from the high-pressure accumulator 125 into the low-pressure vessel 126. In one embodiment, the aluminum layer 602 is made of 7075 aluminum and has a thickness of 0.75 inches, which provides adequate structural strength and can be formed to the required shape.

The carbon/epoxy layer 604 can include carbon fiber windings set in an epoxy bed. In one embodiment, the quantity and orientation of the carbon fiber windings in the carbon/epoxy layer are selected so that the carbon/epoxy layer can carry about 60% of the pressure load of the high-pressure accumulator 125. For example, long fibers of the epoxy winding can be wound radially about the aluminum vessel. In one embodiment, the carbon/epoxy layer 604 is made of ultra high modulus carbon and epoxy consisting of epichlorohydrin and bisphenol-A, and has a thickness of between 0.25 and 1.5 inches, depending on vessel size and pressure rating.

The plastic layer 606 can act as a liner inside of the aluminum shell. In one embodiment, the plastic layer is a rotomolded plastic liner formed of high-density polyethylene (HDPE). In one embodiment, the plastic layer is rotomolded in place inside the aluminum shell. Because of its elasticity, the plastic layer increases the number of pressure cycles the high-pressure accumulator 125 can withstand. The plastic layer also increases the lifetime of the flexible bladder by providing a very smooth surface that the flexible bladder can slide against. In one embodiment, the plastic layer 606 is made of high density polyethylene plastic and has a thickness of 0.0625 inches.

In one embodiment, the wall of the high-pressure accumulator 125 can also include a nonstructural fiberglass layer exterior to the carbon/epoxy layer. The nonstructural fiberglass layer allows users to detect if the high-pressure accumulator has suffered any impact or has been excessively abraded. In one embodiment, the nonstructural fiberglass layer is made of any available long stranded fiberglass and has a thickness of 0.01 inches, so that an impact to the high-pressure accumulator 125 easily destroys the fiberglass layer but protects the carbon layer underneath.

Figure 7:
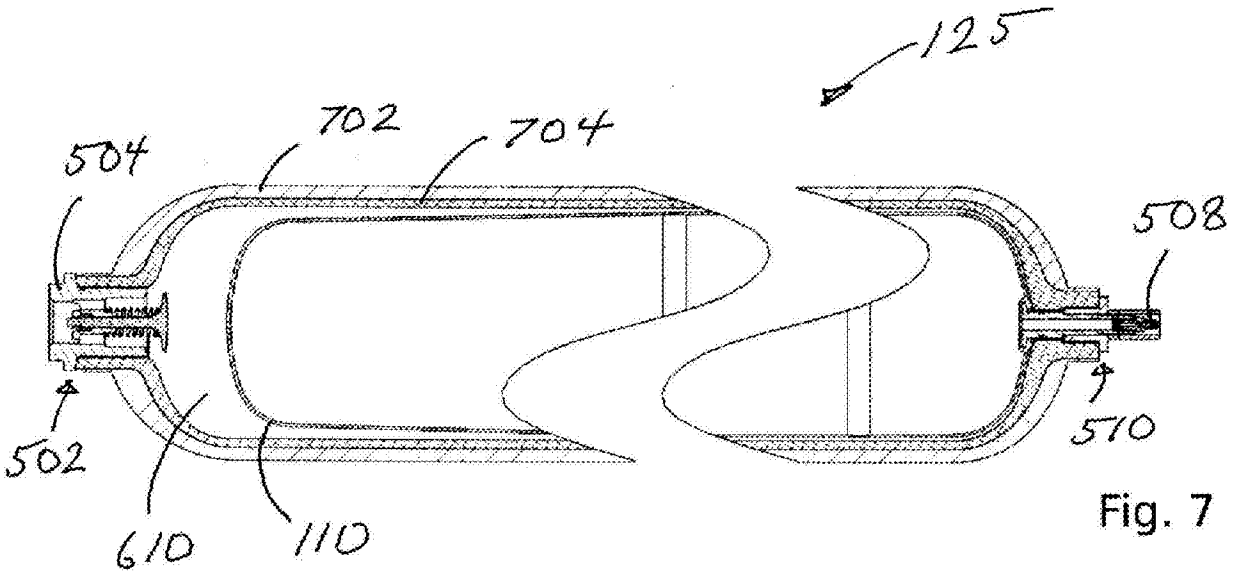
FIG. 7 is a cross section side view of a high-pressure accumulator for an integral accumulator/reservoir system made in accordance with the present invention.

FIG. 7 is a cross section side view of a high-pressure accumulator for an integral accumulator/reservoir system made in accordance with the present invention. In this example, the high-pressure accumulator 125 has a nonstructural fiberglass layer 702 exterior to a high-pressure accumulator wall 704, which defines the high-pressure accumulator cavity 610. The poppet valve assembly 504 is threaded into the poppet valve accumulator opening 502 defined by the high-pressure accumulator wall 704. The fill valve assembly 508 is threaded into the fill valve accumulator opening 510 and secures the flexible bladder 110 within the high-pressure accumulator cavity 610.

FIG. 8 is a detailed cross-section view of a poppet valve for a high-pressure accumulator for an integral accumulator/reservoir system made in accordance with the present invention. The poppet valve assembly 504 includes a poppet valve stem 802 biased towards the high-pressure accumulator cavity 610 and a poppet valve seat 804. When the flexible bladder is precharged, but no pressurized hydraulic fluid is present in the high-pressure accumulator cavity 610, the flexible bladder presses against the poppet valve stem 802 and seats the poppet valve stem 802 on the poppet valve seat 804. This closes the poppet valve assembly 504 to prevent the flexible bladder from passing through the poppet valve port 806. When pressurized hydraulic fluid is present in the high-pressure accumulator cavity 610, the flexible bladder is compressed and hydraulic fluid is free to pass in and out of the poppet valve port 806.

In one embodiment, the poppet valve stem 802 is attached to an actuator which can close the poppet valve in response to a shut off signal, stopping flow through the threaded poppet valve assembly 504 into or out of the high-pressure accumulator cavity 610. This can be used to prevent vehicle movement by preventing flow of hydraulic fluid to and from the integral accumulator reservoir system in the braking energy regeneration system. The shut off signal can be generated locally on the vehicle or remotely.

FIG. 9 is a detailed cross-section view of a fill valve assembly for a high-pressure accumulator for an integral accumulator/reservoir system made in accordance with the present invention. The fill valve assembly 508 is threaded into the fill valve accumulator opening 510 and secures the flexible bladder 110 within the high-pressure accumulator cavity. The flexible bladder 110 is precharged with a gas through the fill valve 902. The fill valve 902 can have a readily available fitting, such as a Schraeder valve. In one embodiment, the flexible bladder 110 can be charged to working pressure with nitrogen.

Figure 10:
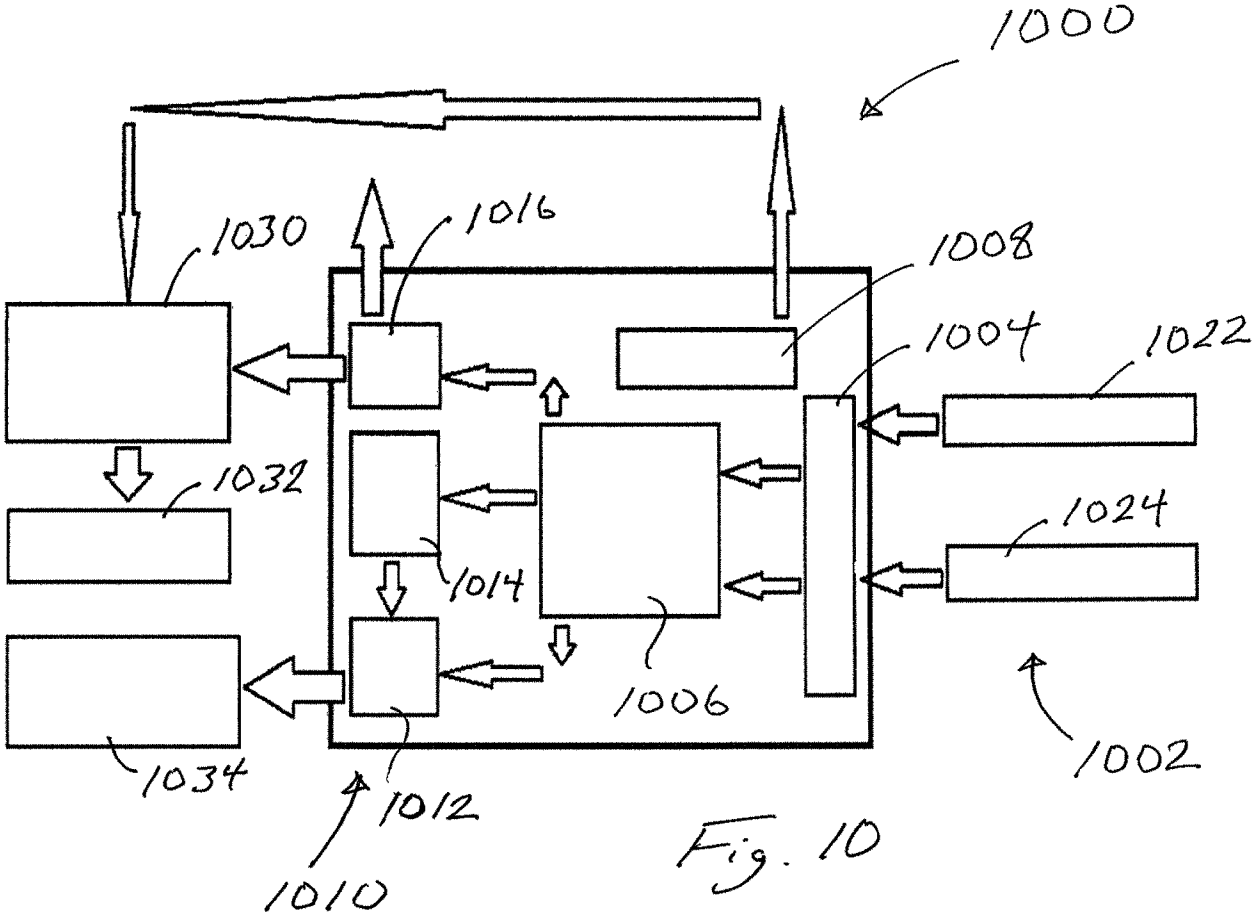
FIG. 10 is a block diagram of a control system for a sensor module for use with a high-pressure accumulator for an integral accumulator/reservoir system made in accordance with the present invention.

FIG. 10 is a block diagram of a control system for a sensor module for use with a high-pressure accumulator for an integral accumulator/reservoir system made in accordance with the present invention. The sensor module 1000 can be operably connected to the aluminum layer of the high-pressure accumulator wall to monitor the high-pressure accumulator. In one embodiment, the sensor module 1000 is bonded to the aluminum layer of the high-pressure accumulator.

The sensor module 1000 can be a self-contained unit applied to the high-pressure accumulator. The sensor module 1000 physically can include all the components on a very small printed circuit board. Other components can include Wheatstone bridges for small signal measurement, current drivers for valve actuation in the poppet assembly, appropriate communications chip, wireless communications devices, batteries, and required power circuitry. The sensor module 1000 can optionally be powered from an off-module power source, such as the vehicle battery and/or alternator, when power demands are too large for an onboard power source. The optional communication interface 1010 can communicate locally or remotely over the Internet using standard protocols such as Wi-Fi, Bluetooth, Zigbee, CAN, GSM, CDMA or the like.

The sensor module 1000 includes a sensor 1002, an analog-to-digital converter 1004 operably connected to the sensor 1002, a central processing unit 1006 operably connected to the analog-to-digital converter 1004, and a communication interface 1010 operably connected to the central processing unit 1006. The sensor 1002 can include one or more strain gauges 1022, one or more temperature sensors 1024, combinations thereof, or the like. The communication interface 1010 can include a wireless transceiver 1016, a CAN/BUS communication chip 1014, and/or a physical connector 1012. The sensor module 1000 can also include global positioning system/Global System for Mobile Communications (GPS/GSM) interface 1008 and/or an optional display (not shown). The optional display can be a locally available LCD display providing information about the sensor module 1000 and/or the integral accumulator/reservoir system.

In one embodiment, the sensor 1002 is one or more strain gauges 1022 operable to detect strain in the aluminum layer of the high-pressure accumulator wall. When the sensor 1002 is a strain gauge, the central processing unit 1006 can use the detected strain to calculate parameters for the high-pressure accumulator such as the number of pressure cycles experienced, the maximum pressure experienced, the pressure history, or the like. Firmware on the central processing unit 1006 can provide functions which correlate the values from the strain gauges into meaningful pressure, cycle, and volume numbers. When the central processing unit 1006 detects or calculates a condition that could lead to a potential failure of the high-pressure accumulator, the central processing unit 1006 can alert operators over the display, through the communication interface 1010, and/or can initiate automatic action to relieve pressure in the high-pressure accumulator. Examples of conditions that could be of concern include number of pressure cycles reaching accumulator end-of-life or excessive pressure loading. The strain gage can also be used to calculate the pressure or fluid volume in the high-pressure accumulator tank.

In another embodiment, the sensor 1002 can be one or more temperature sensors 1024 operable to detect the temperature of the aluminum layer. When the sensor 1002 is a temperature sensor, the central processing unit 1006 can use the detected temperature to calculate parameters for the high-pressure accumulator such as tank fluid pressure, tank fluid volume, or the like. The detected temperature at the aluminum layer also indicates the temperature of the hydraulic fluid and gas inside the high-pressure accumulator because the aluminum layer is thermally conductive. The temperature sensor 1024 can be any sort of temperature sensing device, such as a thermocouple, thermistor, silicon, or other electric temperature sensing device. The detected Temperature can be used to determine the pressure and/or volume of the hydraulic fluid in the high-pressure accumulator through a correlation such as the ideal gas law and/or thermodynamic tables.

The analog-to-digital converter 1004 can be any suitable converter for changing an analog signal from the sensor 1002 to a digital signal, as required for the central processing unit 1006. The central processing unit 1006 can be in a processor operable to carry out instructions and manage data for the sensor module 1000. In one example, the central processor unit 1006 can be a microprocessor. The central processing unit 1006 can also include or be associated with memory and/or storage for the instructions and data.

The communication interface 1010 can include a wireless transceiver 1016, a CAN/BUS communication chip 1014, and/or a physical connector 1012, implemented as one or more integrated circuits. The wireless transceiver 1016 can communicate wirelessly with devices external to the sensor module 1000. Those skilled in the art will appreciate that the wireless transceiver 1016 can operate over various protocols such as Wi-Fi, Bluetooth, Zigbee, CAN, GSM, CDMA or the like. The wireless transceiver 1016 can communicate locally or over a long distance. In one embodiment, the wireless transceiver 1016 exchanges information with the central processing unit 1006 and provides information to an accumulator monitoring website 1030. The accumulator monitoring website 1030 can track the physical location of the integral accumulator/reservoir systems, and receive and display operating information about the integral accumulator/reservoir systems. The accumulator monitoring website 1030 can store accumulator history in an online database 1032. The sensor module 1000 can also receive queries from the accumulator monitoring website 1030 through the wireless transceiver 1016. In one embodiment, the sensor module 1000 can also include a GPS/GSM interface 1008 to provide location information for the integral accumulator/reservoir system to the accumulator monitoring website 1030.

The communication interface 1010 can include a CAN/BUS communication chip 1014. The CAN/BUS (controller-area network) standard is a vehicle bus standard designed to allow microcontrollers and devices to communicate with each other within a vehicle without a host computer. The can bus communication chip 1014 communicates with the central processing unit 1016 and the physical connector 1012. In one embodiment, the CAN/BUS communication chip 1014 exchanges information with the central processing unit 1006 and communicates information with the vehicle CAN/BUS 1034 through the physical connector 1012. In one embodiment, the central processing unit 1006 can also communicate directly with the vehicle CAN/BUS 1034 through the physical connector 1012. The physical connector 1012 can also lead be used to provide power to the sensor module 1000.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. An integral accumulator/reservoir system, the system comprising:

a low pressure vessel having a low-pressure vessel wall defining a low-pressure vessel cavity;

a high-pressure accumulator having a high-pressure accumulator wall defining a high-pressure accumulator cavity, the high-pressure accumulator being disposed in the low-pressure vessel cavity, the high-pressure accumulator wall including an aluminum layer;

a flexible bladder, the flexible bladder being disposed in the high-pressure accumulator cavity; and a sensor module operably connected to the aluminum layer.

2. The system of claim 1 wherein the sensor module includes a strain gauge operable to detect strain in the aluminum layer.

3. The system of claim 2 further comprising a central processing unit operably connected to the strain gauge, the central processing unit being operable to use the detected strain to calculate a parameter selected from the group consisting of number of pressure cycles, maximum pressure, and pressure history.

4. The system of claim 1 wherein the sensor module includes a temperature sensor operable to detect temperature of the aluminum layer.

5. The system of claim 4 further comprising a central processing unit operably connected to the temperature sensor, the central processing unit being operable to use the detected temperature to calculate a parameter selected from the group consisting of tank fluid pressure and tank fluid volume.

6. The system of claim 1 wherein the sensor module comprises:

a sensor selected from the group consisting of a strain gauge and a temperature sensor;

an analog-to-digital converter operably connected to the sensor;

a central processing unit operably connected to the analog-to-digital converter; and a communication interface operably connected to the central processing unit.

7. The system of claim 6 wherein the communication interface is selected from the group consisting of a wireless transceiver and a CAN/BUS communication chip.

8. The system of claim 1 wherein the sensor module further comprises a GPS/GSM interface.

9. The system of claim 1 further comprising a carbon/epoxy layer exterior to the aluminum layer, and a plastic layer interior to the aluminum layer and adjacent to the flexible bladder.

10. The system of claim 9 is further comprising a nonstructural fiberglass layer exterior to the carbon epoxy layer.

11. A braking energy regeneration system for use with a vehicle prime mover, the system comprising:

a power transfer module operably connected to the vehicle prime mover;

a hydraulic pump system operably connected to the power transfer module, the hydraulic pump system having an axial piston pump in fluid communication with a fixed displacement pump;

an integral accumulator/reservoir system operably connected to the hydraulic pump system, the integral accumulator/reservoir system having a high-pressure accumulator, a low-pressure vessel, and a flexible bladder; and a control system operably connected to the vehicle prime mover, the power transfer module, the hydraulic pump system, and the integral accumulator/reservoir system;

wherein the fixed displacement pump is in fluid communication with the low-pressure vessel, the fixed displacement pump is in fluid communication with the axial piston pump, and the axial piston pump is in fluid communication with the high-pressure accumulator; and wherein the integral accumulator/reservoir system comprises;

the low pressure vessel having a low-pressure vessel wall defining a low-pressure vessel cavity;

the high-pressure accumulator having a high-pressure accumulator wall defining a high-pressure accumulator cavity, the high-pressure accumulator being disposed in the low-pressure vessel cavity, the high-pressure accumulator wall including an aluminum layer;

the flexible bladder being disposed in the high-pressure accumulator cavity; and a sensor module operably connected to the aluminum layer.

12. The system of claim 11 wherein the sensor module includes a strain gauge operable to detect strain in the aluminum layer.

13. The system of claim 12 further comprising a central processing unit operably connected to the strain gauge, the central processing unit being operable to use the detected strain to calculate a parameter selected from the group consisting of number of pressure cycles, maximum pressure, and pressure history.

14. The system of claim 11 wherein the sensor module includes a temperature sensor operable to detect temperature of the aluminum layer.

15. The system of claim 14 further comprising a central processing unit operably connected to the temperature sensor, the central processing unit being operable to use the detected temperature to calculate a parameter selected from the group consisting of tank fluid pressure and tank fluid volume.

16. The system of claim 11 wherein the sensor module comprises:

a sensor selected from the group consisting of a strain gauge and a temperature sensor;

an analog-to-digital converter operably connected to the sensor;

a central processing unit operably connected to the analog-to-digital converter; and a communication interface operably connected to the central processing unit.

17. The system of claim 16 wherein the communication interface is selected from the group consisting of a wireless transceiver and a CAN/BUS communication chip.

18. The system of claim 11 wherein the sensor module further comprises a GPS/GSM interface.

19. The system of claim 11 further comprising a carbon/epoxy layer exterior to the aluminum layer, and a plastic layer interior to the aluminum layer and adjacent to the flexible bladder.

20. The system of claim 19 further comprising a nonstructural fiberglass layer exterior to the carbon epoxy layer.

* * * * *